US005616389A

United States Patent [19]

Blatz

[11] Patent Number: 5,616,389

[45] Date of Patent: Apr. 1, 1997

[54] SURFACE COVERING TILE

[76] Inventor: Warren J. Blatz, No. 40 Bedford Circle N.E., Calgary, Alberta T3K 1L1, Canada

[21] Appl. No.: 550,236

[22] Filed: Oct. 30, 1995

[51] Int. Cl.[6] ..... B32B 3/06

[52] U.S. Cl. ..... 428/45; 428/58; 428/44; 404/36; 52/177

[58] Field of Search ..... 428/44, 45, 58; 404/36, 41; 52/177, 180, 181, 588.1; 15/217

[56] References Cited

U.S. PATENT DOCUMENTS 5,193,878 3/1993 Weaver ..... 296/162

FOREIGN PATENT DOCUMENTS 1067738 12/1979 Canada .
1145784 5/1983 Canada .
1259083 9/1989 Canada .
2009347 12/1990 Canada .
2077335 9/1991 Canada .
2035976 3/1994 Canada .

*Primary Examiner*—Alexander Thomas
*Attorney, Agent, or Firm*—Charles P. Boukis, Jr.

[57] ABSTRACT

A surface covering tile is disclosed having integral connecting elements about its edges to enable hinged interconnection between adjacent-like tiles. The connecting elements are longitudinally arranged about the peripheral edges of the tile and comprise semi-cylindrical curved female elements, protruding tongue elements and semi-cylindrical bar-like male elements. The elements are arranged such that the female and tongue elements cooperate to engage with the male elements of adjacent tiles. The tile is further adapted to receive a surface covering such as a carpet or mat, preferably an air permeable covering which will permit air to pass through apertures in the surface of the tile to the ground below.

14 Claims, 5 Drawing Sheets

SURFACE COVERING TILE

BACKGROUND OF THE INVENTION

The present invention relates to surface covering tiles having integral connecting elements. The tiles are particularly useful to construct portable floor or ground coverings.

Persons who must support themselves on the ground, whether for rest or work, often wish to have a clean, dry, personal surface on which to do so. Further those who must stand for long periods of time on hard surfaces such as concrete flooring, whether interior or exterior, desire a relatively more resilient surface on which to support themselves to lessen the strain. Still further, campers often wish to provide a ground cover adjacent the doors of RV's or trailers or as a floor of a gazebo.

Previous surface covering tiles have allowed only limited portability as they are either too bulky or require too much effort to assemble and disassemble.

By way of example of prior art devices is Canadian patent No. 1,067,738 granted Dec. 11, 1979 to SOLAND relating to a ground covering of interconnections adjacently disposed plates. The plates are tensioned by cables and spaced apart by spacers of a specific construction to help lock adjacent plates from relative movement.

Canadian patent No. 1,145,784 granted May 3, 1983 to BERGQVIST relates to a surface covering and provides a surface covering for game courts and the like comprising a number of mutually detachable joined plates of a moldable resilient plastic. The plates are joined by telescoping peg elements.

Canadian patent No. 2,035,976 granted Mar. 22, 1994 to GEISEN ET AL relates to plates of plastic material for covering terraces and provides a tenon and groove—dovetail top—of connection between adjacent plates.

Canadian laid open application No. 2,077,335 of MacLEOD laid open on Sep. 3, 1991 relates to a cover for an area of ground for a stadium or the like having a plurality of units with vertical orientated male/female connectors and with spikes to support the unit above a grass surface aperture and the construction of the spikes permit for air circulation under the surface of the plates or units. The spikes provide a dangerous aspect to the handling of these units without skilled personnel.

The present invention seeks to provide a surface covering tiles which are easily connected, as portable, resilient and durable and which are easily stored without sharp spikes or the like which could cause injury in handling.

SUMMARY OF THE INVENTION

The foregoing aspects are achieved by a surface covering tile having a first and second surface in spaced relation with edges about its periphery. The edges have integral connecting elements which hingedly connect to adjacent surface covering tiles. The surface covering tile may be adapted to support a finishing surface.

The invention in one aspect provides a molded plastic tile having means for detachable securement to a like adjacent tile for covering a selected surface area. The tile comprises a top surface, an undersurface and a plurality of sides, at least one of the sides of the tile having at least one longitudinally bar-like bead adjacent a bottom edge thereof with the bead extending outwardly of the one side. At least another side of the tile has a plurality of recess means spaced longitudinally along a bottom edge thereof, the recess means extending outwardly and upwardly and adapted to receive a bar-like bead of another like confronting tile. The another side includes tongue means interspersed with the recess means and cooperating with the bar-like bead and recess means for detachably locking a bar-like bead of an adjacent tile in the recess means of the tile.

More particularly there is provided a molded plastic tile adapted to be detachably secured to other like plastic tiles to cover a selected surface area, the tile comprising a plate portion having an upper surface, an underside and peripheral sides extending downwardly generally perpendicular to the upper surface. At least one side of the tile has at least one longitudinal extending locking bead adjacent a bottom edge thereof. At least one second side of the tile has at least one female locking means, the female locking means including a longitudinally extending curved recess portion adjacent a bottom edge of the second side and at least one flexile locking tongue whereby two like tiles may be detachably secured together by the male bead of one tile being received in the female recess of the other tile, with the flexible tongue cooperating with the bead to detachably maintain the tiles in an interlocked position.

The upper surface of the tile may be defined by a peripheral rim and further includes a finishing surface element such as an air permeable carpet secured to the upper surface and within the rim.

Preferably there are two longitudinally spaced cylindrical locking beads adjacent the bottom edge of the one side and there are two sets of longitudinally spaced female locking means, spaced such that each locking bead is associated with a set of female locking means.

Each set of female locking means preferably includes a plurality of spaced female locking elements, each female locking element comprising a J-shaped element with an inner curvature compatible with the curvature of the bead. A flexible locking tongue is interspersed with adjacent lock elements.

The underside of the plate portion of the tile has an array of diagonally oriented walls defining substantially square triangular sections adjacent the sides of the tile and substantially rectangular portions inwardly thereof.

At least some of the bottom edges of the walls have upwardly directed recesses spaced from the adjacent posts whereby circulation of air is permitted between sections.

Preferably the plate portion has an array of small through apertures therein within at least some of the sections to permit air to circulate from above the tile to the underside.

The arrays of apertures preferably comprise a plurality of rows of apertures, adjacent apertures within a row being interspersed by a portion of the underside of reduced thickness.

Other features and aspects of the invention will become apparent from the detailed description of a preferred embodiment of the invention to follow.

DETAILED DESCRIPTION OF THE PREFERRED EMBODIMENT

Figure 1:
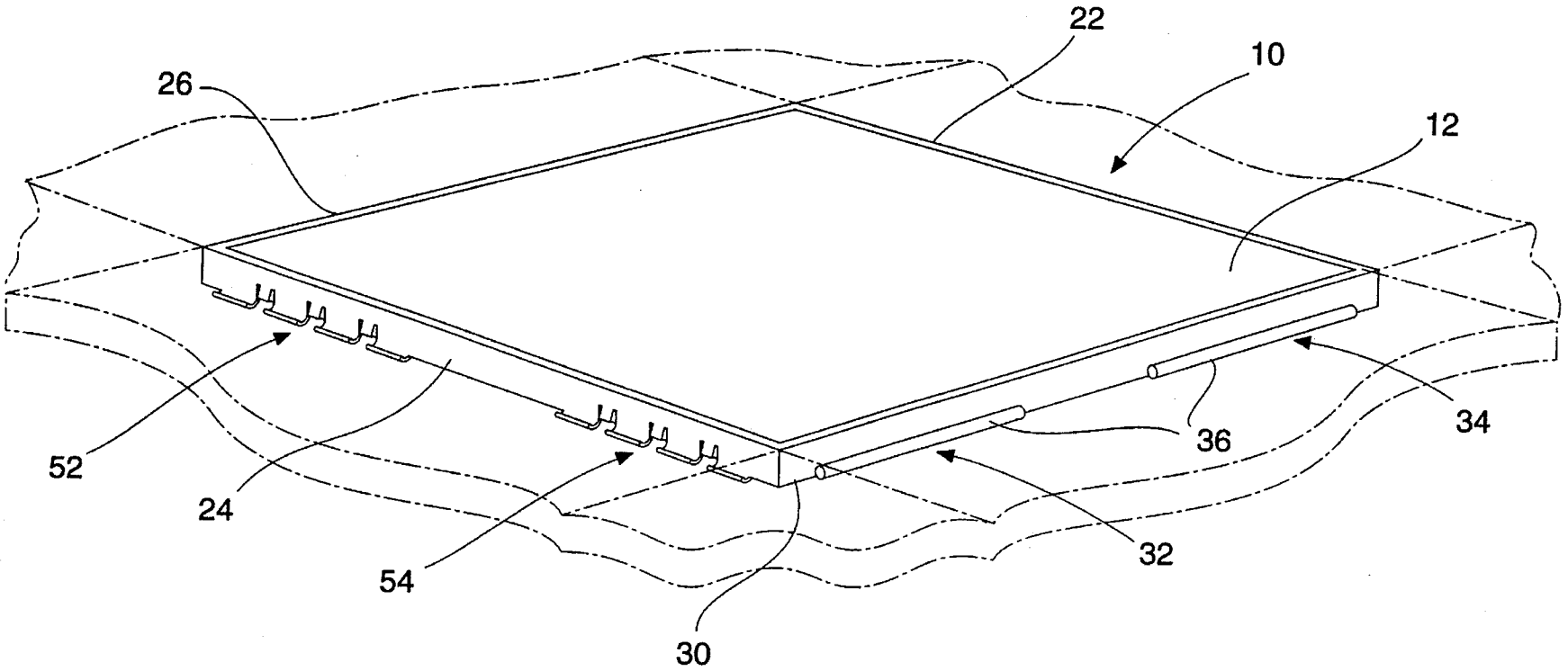
FIG. 1 is a perspective view of a tile, (with covering), from one corner showing male and female connectors and showing like tiles in phantom lines.
Figure 2:
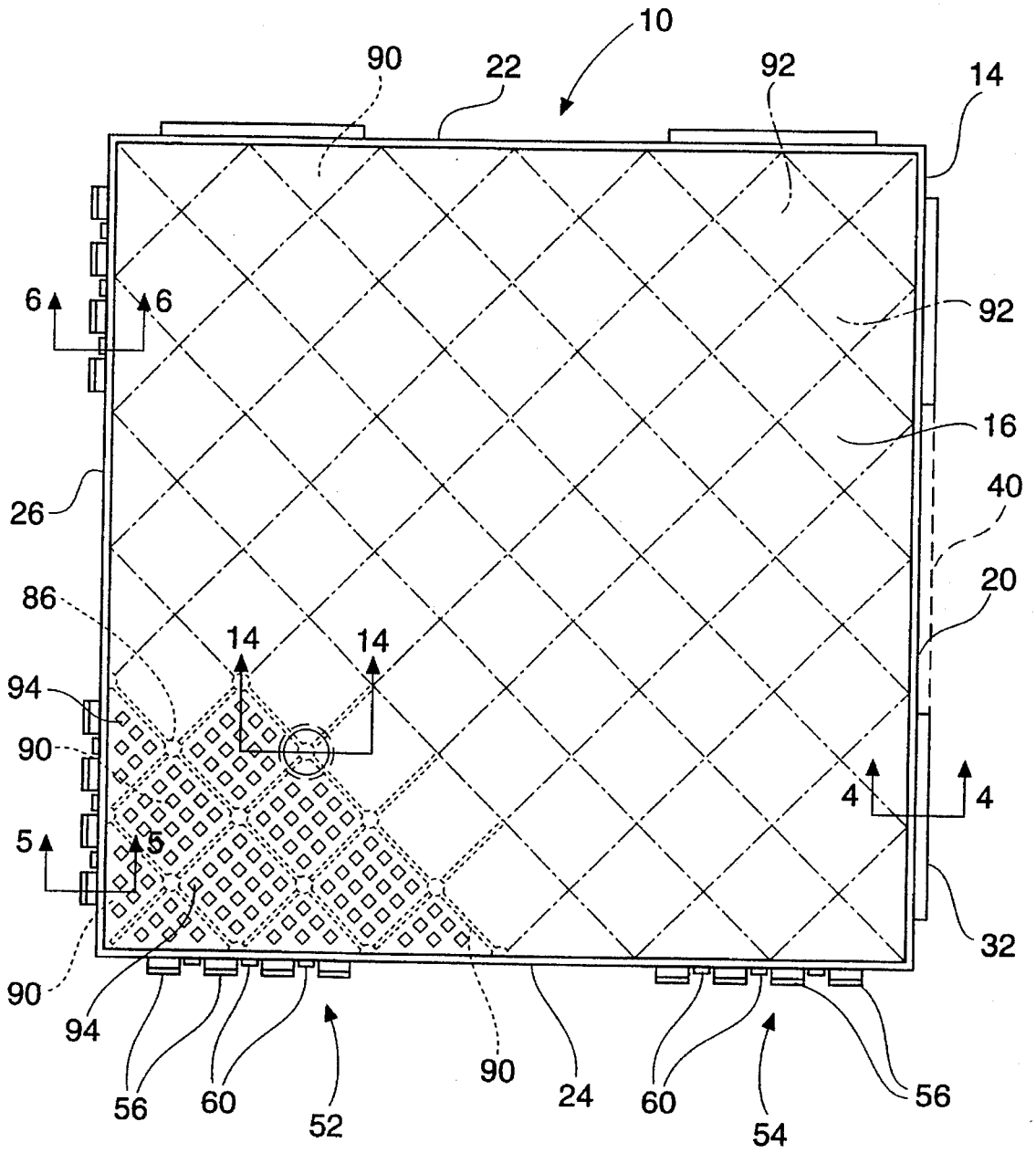
FIG. 2 is a top plan view of a tile without a cover.
Figure 3:
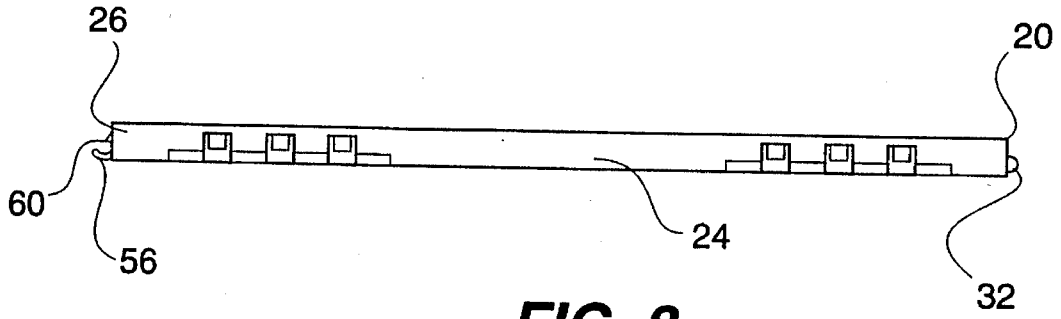
FIG. 3 is a front (side) view of the tile shown in FIG. 2.

Referring to FIGS. 1, 2 and 3, there is shown a single tile 10 in perspective view with an air permeable covering 12 such as outdoor carpeting on the top or upper surface, which covering is of the indoor-outdoor carpet type. Adjacent tiles of the same construction are shown in phantom lines in order to make a platform of selected size. FIGS. 2 and 3 illustrate tile 10 in top view and side view without covering 12.

Tile 10 has an upper peripheral lip 14 to contain air permeable covering 12 and the height of the lip is comparable to the height of the covering. Under covering 12, tile 10 has upper surface 16.

Sides 20, 22 are mirror images of each other and sides 24, 26 are mirror images of each other so that only sides 20 and 24 will be further detailed.

Figure 4:
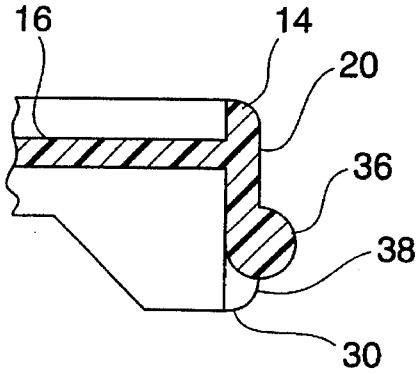
FIG. 4 is a sectional view along line 4—4 of FIG. 3 of a bead (male) member of the interconnecting elements.

Tile side 20, (as well as side 22), has a lower edge 30 with two longitudinal portions 32, 34 of the lower edge having a cylindrical, bar-like bead or male member 36 as more fully shown in section in FIG. 4. Bead 36 has a bottom 38 spaced a predetermined distance from lower edge 30.

Although two portions 32, 34 are shown, a variation of the invention would have a single longitudinal bar as shown in FIG. 2 with dotted line 40.

Tile side 24, (as well as side 26), has a lower edge 50, which is coplanar with lower edge 30 of side 20 and has two sections 52, 54 each with a plurality, (four are shown), of like outwardly, upwardly curving recesses defined by female elements 56. Elements 56 are flexible and are longitudinally spaced along side 24.

Figure 5:
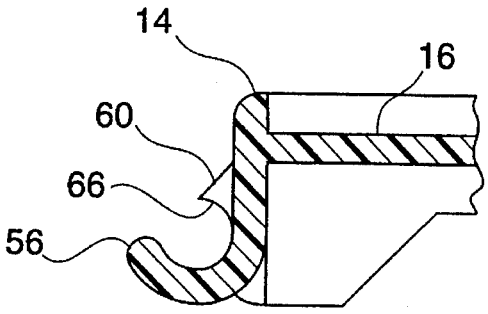
FIG. 5 is a sectional view along lines 5—5 on FIG. 3 of a recess (female) member of the interconnection elements.
Figure 6:
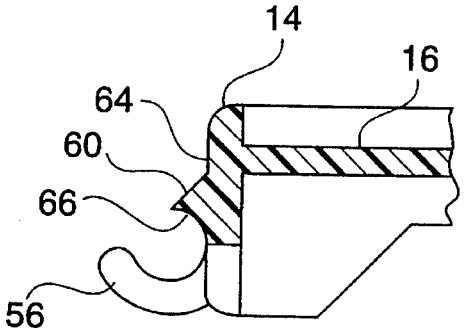
FIG. 6 is a sectional view along line 6—6 of FIG. 3 showing a tongue member of the intermediate elements.

Intermediate the J-shaped elements 56, as shown in FIG. 3 and FIGS. 5–11, are flexible tongues 60 defined by slots 62 on either side thereof extending downwardly from an upper portion 64 of side 24, which construction permits tongues 60 to flex inwardly and outwardly slightly and return to a normal position, as shown in sectional views in FIGS. 5 and 6. Upper portion 64 is effectively a flexible hinge for tongue 60.

The lower front surface 66 of tongue 60 has a radius of curvature compatible with that of J-shaped elements 56 and bead 36.

Figure 7:
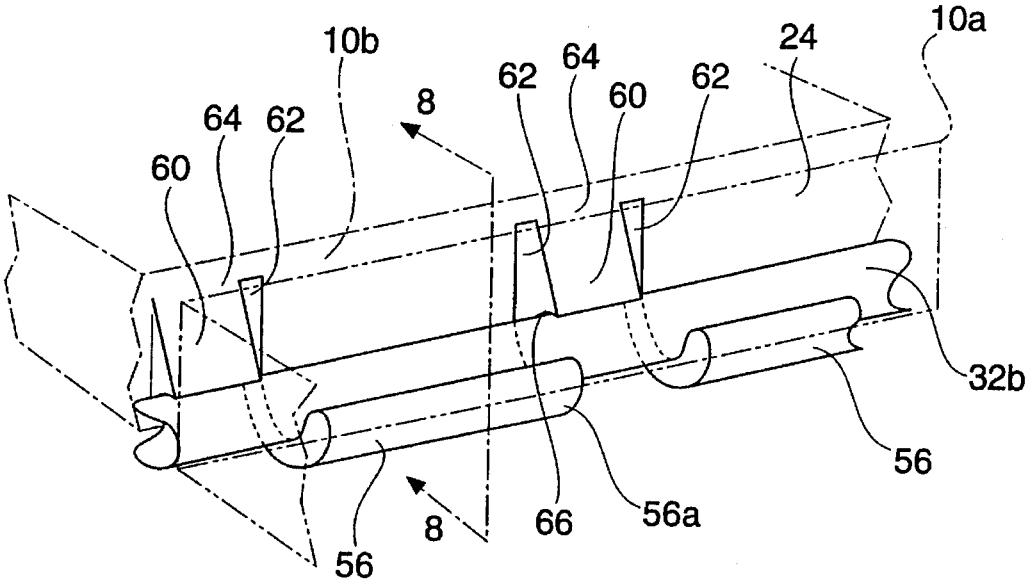
FIG. 7 is a perspective view of portions of the connecting means of connected tiles, the tile with the male bead being shown partly in phantom.
Figure 8:
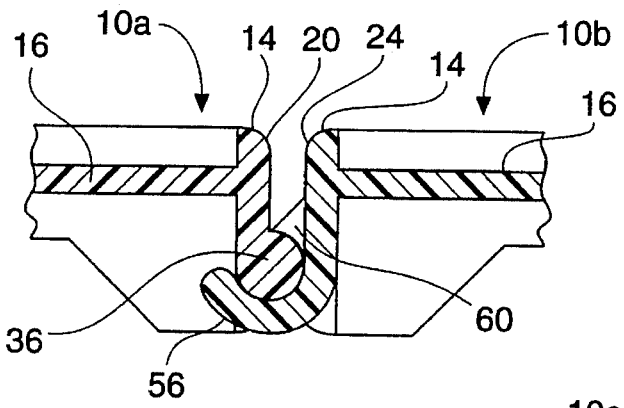
FIG. 8 is a sectional view along lines 9—9 of FIG. 7.

FIGS. 7 and 8 illustrate in perspective and sectional views respectively how two like tiles 10*a* and 10*b* are connected, both of the tiles being shown in FIG. 7, only in part and one, 10*b*, in phantom lines. In connecting adjacent tiles, the tiles are moved relative to each other in a push/pull manner.

Figure 9:
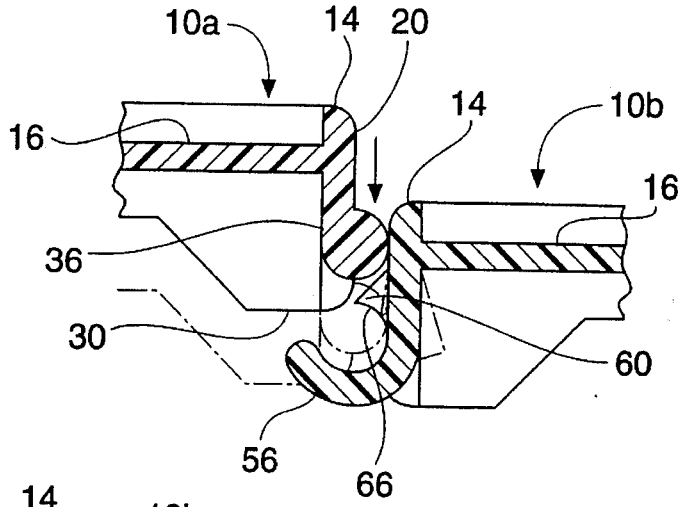
FIG. 9 is a sectional view along the lines of FIG. 8 showing the connection of adjacent tiles.

FIG. 9 illustrates the connection between two adjacent tiles in cross-section similar to FIG. 8. Tile 10*a* and tile 10*b* are moved relative to each other whereby bead 36 is pushed downwardly to flex tongue 60 inwardly, (as shown in dotted lines). Once bead 36 is within J-shaped element 56, tongue 60 flexes back to its natural or normal position as shown in FIG. 8. It will be apparent that to assemble two adjacent tiles, one tile 10*a* may be manually tilted slightly so that one end of bead 36 is forced into engagement with an adjacent J-shaped element 56 and this is repeated progressively along the length of the side of tile 106. The assembly or connection can also be achieved by placing tiles 10*a* and 10*b* on the ground, for example and aligning bead 36 above J-elements 56 and then standing on tile 10*a* to snap the beads 30 into the adjacent J-elements 56.

Figure 10:
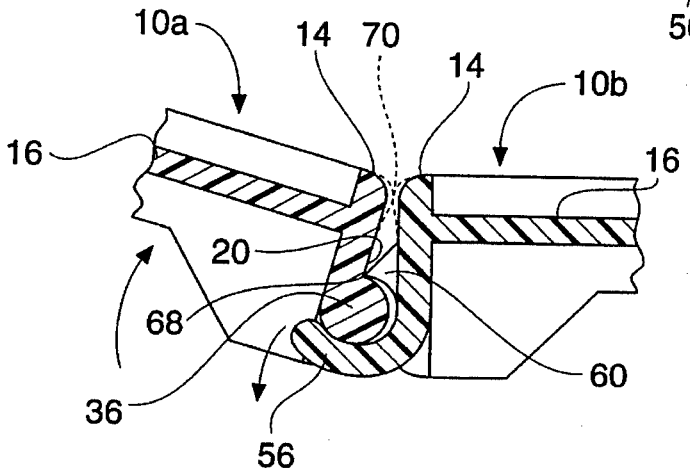
FIG. 10 is a sectional view showing one method of separating adjacent tiles.
Figure 11:
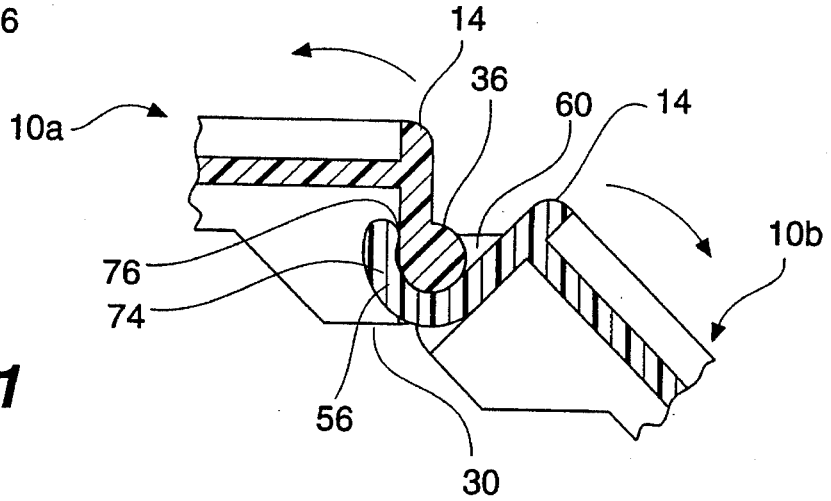
FIG. 11 is a sectional view showing another method of separating adjacent tiles.

In separating the tiles, FIGS. 10 and 11 illustrate two methods, both simply being the angling of tiles 10*a* and 10*b* relative to each other. As shown in FIG. 10, tile 10*a* and 10*b* are twisted so that initially tongue 60 engages side 20 of tile 10*a* at 68 and then the peripheral rim 14 of both tiles touch at 70, (shown in dotted lines), whereupon further relative pivotal movement causes the two connectors to pivot relative to each other about pivot 70, bead 30 slipping out of the connector formed by tongue 60 and J-element 56 due to the flexibility of these elements. FIG. 11 illustrates twisting the two tiles 10*a* and 10*b* such that the end 74 of J-element 56 contacts the inner surface of side 20 at 76, again defining a pivot point about which further twisting or pivoting causes separation of bead 36 from the connector defined by tongue 60 and J-element 56.

Figure 12:
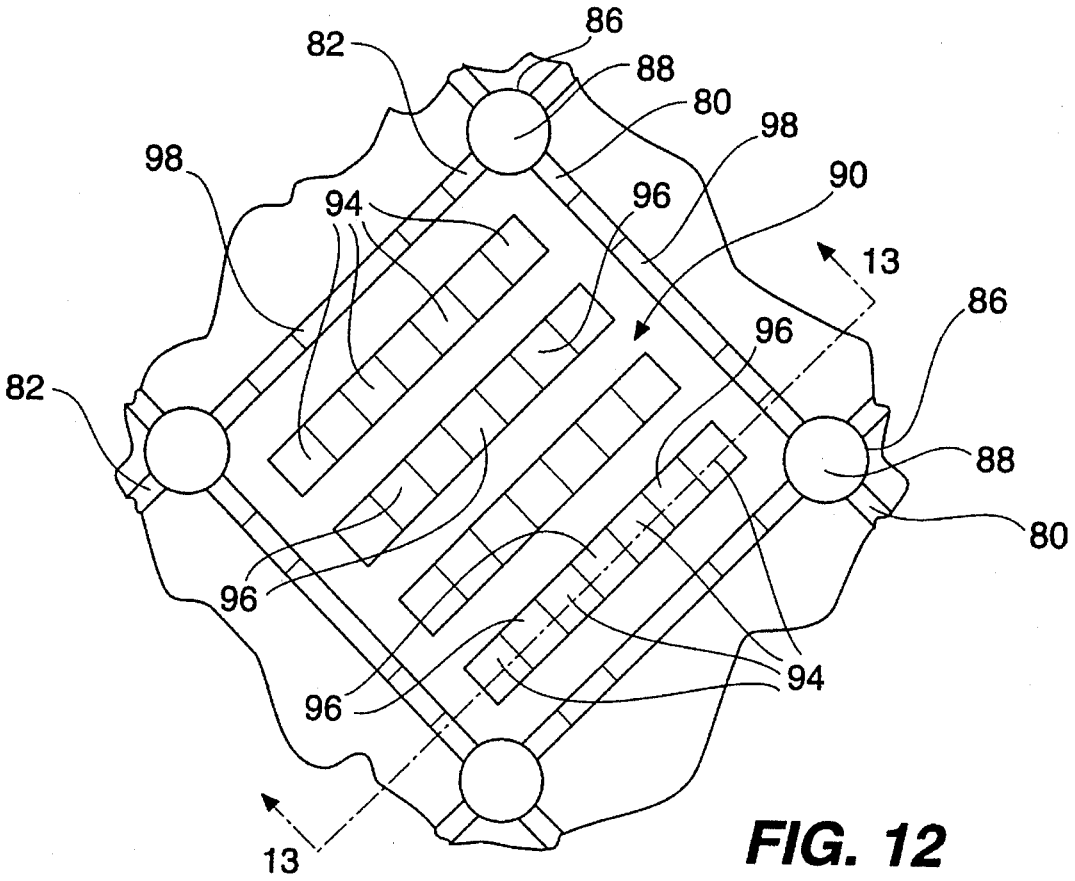
FIG. 12 is a bottom plan view of a part of the tiles showing a section defined by interior support walls.
Figure 14:
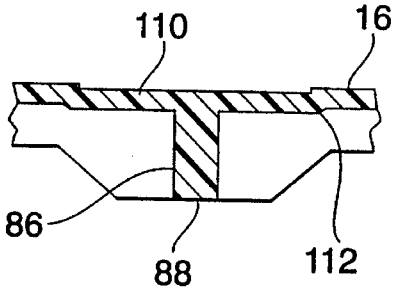
FIG. 14 is a sectional view along lines 14—14 of FIG. 2 showing a post and molding indentation.

FIGS. 12 and 14 illustrate in further detail, the molded construction of tile 10 to provide a lightweight, yet sturdy, tile which may be integrally molded without difficulty.

Figure 13:
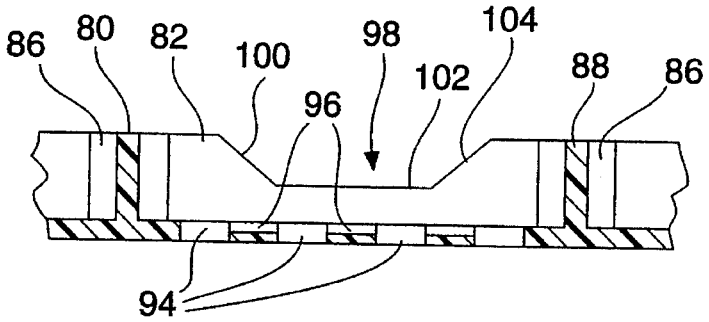
FIG. 13 is a sectional view along lines 13—13 of FIG. 12.

As previously noted, tile 10 has a peripheral lip 14 of a height to accommodate carpet-like material 12. The underside of tile 10 has a plurality of intersecting diagonal walls 80, 82, the juncture of which include cylindrical post elements 86. The bottom 88 of posts 86 are coplanar with the bottom edges 30 of side walls 20, 22, 24 and 26. Walls 80, 82 define an array of triangular border sections 90 with square interior sections 92, (FIG. 2). Within each section 90, 92, as seen in FIG. 3, is an array of square apertures 94 further shown in an enlarged view of a section 90 in FIG. 12 and in sectional view in FIG. 13. Also shown in FIGS. 12 and 13, (but not shown in FIG. 2), are reduced thickness portions 96 extending between adjacent apertures 94 in a selected longitudinal direction or row. Further, it will be noted that walls 80, as do walls 82, have a recess 98 therein formed by wall portions 100, 102, 104. The apertures 94, reduced thickness portions 96 and recesses 98 reduce material requirements but do not significantly affect the strength of tile 10. Moreover, the recesses 98 cause less "footprint markings" to be left on the surface on which the tile is used (such as grass). Further still, recesses 98 and apertures 94 permit the flow of air and moisture between sections and with that of the environment above the tile with an air permeable surface cover 12.

FIG. 14 illustrates post 86 with a slight depression 110 in the upper surface 16 (and attendant raised portion 112 on the underside) which are for reasons to facilitate molding the tile with reduced flashing, as is well known in the art.

With the type of connection provided by applicant's device, limited pivotal movement of the tiles relative to each other is provided and therefore the tiles will follow the contour of the underlying ground more effectively. As seen in FIGS. 10 and 11, two adjacent tiles will pivot upwardly about 25°, (FIG. 10) and downwardly about 40°, (FIG. 11).

In a prototype, applicant's square tiles 10 are about 19 3/16" square, with side edges 20, 22 about 5/8" in height. The female receiving elements 56 are about 3/4" wide with the locking tongues 60 about 3/8" wide. The beads 32 are about 4 5/8" long. The center to center distance between posts 86 is about 2 9/64" and apertures 94 are about 7/32" square.

Accordingly I have provided an easily molded tile for selective interconnection with like adjacent tiles to form a platform or the like which can be used outside an RV for deck chairs or the like, or adjacent dock areas levelled ground.

I claim:

1. An integrally molded plastic tile having means for detachable securement to a like adjacent tile for covering a selected surface area, said tile comprising:

a top surface, an undersurface and a plurality of sides, at least one of the sides of said tile having at least one longitudinally bar-like bead adjacent a bottom edge thereof, said bead extending outwardly of said one side;

at least another side of said tile having a plurality of recess means spaced longitudinally along a bottom edge thereof, said recess means extending outwardly and upwardly and adapted to receive a bar-like bead of another like confronting tile, said another side further including tongue means interspersed with said recess means and cooperating with said bar-like bead and recess means for detachably locking a bar-like bead of an adjacent tile in said recess means of said tile.

2. A molded plastic tile adapted to be detachably secured to other like plastic tiles to cover a selected surface area, said tile comprising:

a plate portion having an upper surface, an underside to said upper surface and peripheral sides extending downwardly generally perpendicular to said upper surface;

at least one side of said tile having at least one longitudinal extending locking bead adjacent a bottom edge thereof;

at least one second side of said tile having at least one female locking means, said female locking means including a longitudinally extending curved recess portion adjacent a bottom edge of said second side and including at least one flexile locking tongue associated with said recess portion, whereby two like tiles may be detachably secured together by a male bead of one tile being received in a female recess of the other tile with the flexible tongue cooperating with the bead and the recess portion to detachably maintain the tiles in an interlocked position.

3. The tile according to claim 2 wherein said upper surface is defined by a peripheral rim and further including a finishing surface element secured to said upper surface and within said rim.

4. The tile according to claim 2 wherein there are two longitudinally spaced cylindrical locking beads adjacent the bottom edge of said one side.

5. The tile according to claim 4 wherein there are two sets of longitudinally spaced female locking means spaced such that each locking bead may be connected with a set of female locking means.

6. The tile according to claim 5 wherein each set of female locking means includes a plurality of spaced female locking elements, each said female locking element comprising a J-shaped element with an inner curvature compatible with the curvature of said bead and further comprising a flexible locking tongue interspaced between adjacent J-shaped lock elements.

7. The tile according to claim 6 wherein each said locking tongue has an end which has an inner curvature compatible with the curvature of said bead.

8. The tile according to claim 6 wherein said bead and locking means are detachably connected by said bead being aligned substantially vertically above said J-shaped locking elements and forced generally vertically into said locking elements by displacing said flexible tongue elements inwardly.

9. The tile according to claim 8 wherein said tiles are separated by being pivotable relative to each other along the axis of the bead until parts of said tile contact and further pivoting cams said bead past said tongue and out of said locking elements.

10. The tile according to claim 2 wherein said underside of said plate portion has an array of diagonally oriented walls defining substantially square triangular sections adjacent the sides of said tile and defining substantially rectangular portions inwardly thereof.

11. The tile according to claim 10 wherein said walls are integrally molded with post elements having bottom ends, said posts defining corners of said triangular and square sections and said walls having a bottom edge planar with the bottom ends of said posts.

12. The tile according to claim 11 wherein at least some of the bottom edges of said walls have upwardly directed recesses spaced from adjacent posts whereby circulation of air is permitted between adjacent sections.

13. The tile according to claim 10 wherein said plate portion has an array of small, through apertures within at least some of the sections.

14. The tile according to claim 13 wherein said arrays of apertures comprise a plurality of rows of apertures, adjacent apertures within a row being interspersed by portions of the underside of reduced thickness.

* * * * *